US008117755B2

(12) United States Patent
Scimone

(10) Patent No.: US 8,117,755 B2
(45) Date of Patent: Feb. 21, 2012

(54) PRECISION CUTTER

(75) Inventor: Thomas John Scimone, Campbell, CA (US)

(73) Assignee: Slice, Inc., Campbell, CA (US)

( * ) Notice: Subject to any disclaimer, the term of this patent is extended or adjusted under 35 U.S.C. 154(b) by 370 days.

(21) Appl. No.: 12/361,881

(22) Filed: Jan. 29, 2009

(65) Prior Publication Data

US 2010/0186241 A1 Jul. 29, 2010

(51) Int. Cl.

| | |
|---|---|
| ***B26B 3/06*** | (2006.01) |
| ***B26B 3/00*** | (2006.01) |
| ***B26B 1/00*** | (2006.01) |
| ***F41B 13/02*** | (2006.01) |
| ***F41C 27/18*** | (2006.01) |
| ***B43K 23/12*** | (2006.01) |

(52) U.S. Cl. ..... 30/151; 30/317; 30/329; 401/243

(58) Field of Classification Search ..... 30/151, 30/294, 317, 329, 332, 337; 83/565; 401/243, 401/246, 202; 16/436

See application file for complete search history.

(56) References Cited

U.S. PATENT DOCUMENTS

| | | | | |
|---|---|---|---|---|
| 48,953 | A | 7/1865 | Kelsey | |
| 1,794,008 | A * | 2/1931 | Forbes | 81/22 |
| D156,056 | S | 11/1949 | Vander Kuy | |
| 2,677,180 | A | 5/1954 | Schierghofer | |
| 2,786,528 | A * | 3/1957 | Wick | 30/366 |
| D197,228 | S | 12/1963 | Doman | |
| 3,833,037 | A * | 9/1974 | Fish | 81/20 |
| 3,977,077 | A * | 8/1976 | Rebold | 30/151 |
| 4,081,907 | A | 4/1978 | Bosshold | |
| 4,199,632 | A * | 4/1980 | Travis | 428/54 |
| 4,455,894 | A | 6/1984 | Roberts | |
| 4,817,284 | A * | 4/1989 | Sacherman et al. | 30/329 |
| 4,884,342 | A | 12/1989 | McNamara et al. | |
| 4,922,614 | A | 5/1990 | Machida | |
| 4,974,320 | A | 12/1990 | Pelletier | |
| 4,993,156 | A * | 2/1991 | Craven | 30/142 |
| 5,001,955 | A | 3/1991 | Fujiwara | |
| 5,077,901 | A * | 1/1992 | Warner et al. | 30/357 |
| 5,493,781 | A | 2/1996 | Saito | |
| 5,561,905 | A | 10/1996 | Sherman | |
| 5,809,656 | A | 9/1998 | Lindberg | |
| 5,956,796 | A * | 9/1999 | Lodato | 15/167.1 |
| 6,256,888 | B1 | 7/2001 | Shuen | |
| 6,516,521 | B1 * | 2/2003 | Rush et al. | 30/294 |
| 6,615,495 | B1 | 9/2003 | Evens et al. | |
| 6,735,872 | B1 | 5/2004 | Chang | |
| 6,799,918 | B1 * | 10/2004 | Scolnik | 401/195 |
| 7,726,031 | B1 * | 6/2010 | Gibbs | 30/335 |
| 2004/0071493 | A1 * | 4/2004 | Hendrix-Stavropoulos | 401/205 |

* cited by examiner

*Primary Examiner* — Ghassem Alie
*Assistant Examiner* — Bharat C Patel
(74) *Attorney, Agent, or Firm* — James M Smedley LLC; James Michael Smedley, Esq.

(57) ABSTRACT

A precision cutter is disclosed. The cutter is curvilinear in shape, and has an elongated handle with a blade projecting from the top end thereof, and a cap adapted to fit over the blade, the cap being so configured that when in place covering the blade, it provides the appearance of a unitary piece to the cutter. The handle has a weight positioned in it eccentric to the central axis thereof, so that when rolled on a flat surface the handle consistently returns to the same position relative to the flat surface.

9 Claims, 4 Drawing Sheets

PRECISION CUTTER

BACKGROUND OF THE INVENTION

A. Field of the Invention

This invention relates to a cutter for paper and other materials. More specifically, it relates to esthetically pleasing cutter or knife with a concealed blade that is particularly useful in cutting single sheets of paper, or other thin materials, with precision.

B. Description of the Prior Art

There are many patents relating to paper cutters or utility knives that are known in the art. Among them are U.S. Pat. Nos. 5,493,781; 2,677,180; 4,884,342; 4,974,320; 5,001,955; 5,809,656; 4,455,894; 5,561,905; 6,615,495; 4,081,907; D297,076; D197,228; 48,953; D156,056; 6,256,888; and 6,735,872. While each of the patents listed above describe various unique features of paper cutters and similar devices, none describe the particular features of the paper cutter of the present invention.

BRIEF SUMMARY OF THE INVENTION

The invention is an esthetically pleasing curvilinear knife, or cutter, that has a concealed blade, and is suitable for use in precision cutting of thin materials, such as single sheets of paper, thin plastic sheets and the like. The cutter comprises a handle with a blade support structure protruding from the neck thereof, a blade embedded in the blade support structure, and a cap that fits over the blade and blade support structure, thereby concealing the blade from view.

DETAILED DESCRIPTION OF THE INVENTION

Figure 1:
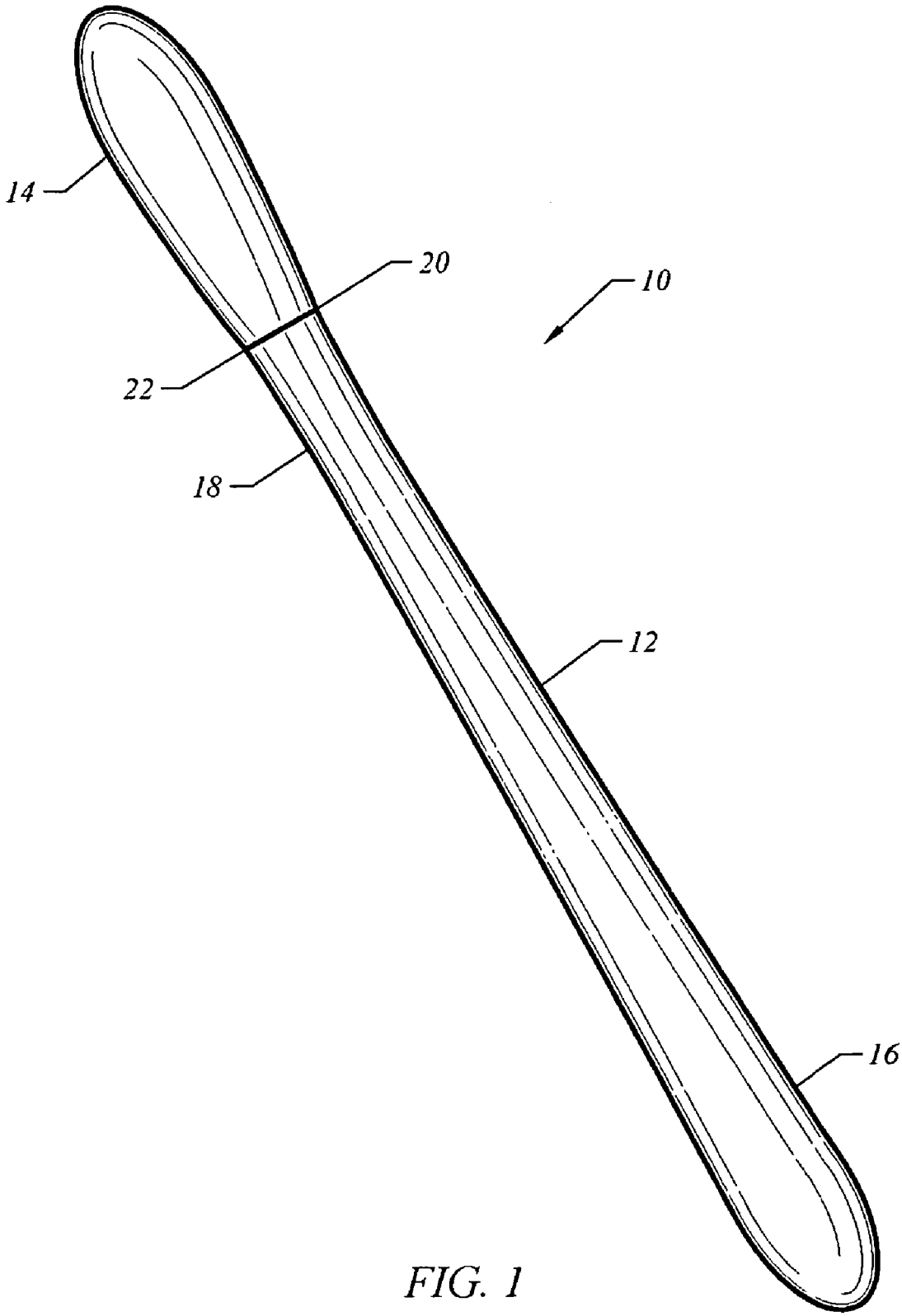
FIG. 1 is a perspective view of the precision cutter of the invention.

The precision cutter of this invention is shown in its entirety in FIG. 1. As shown, the cutter 10 is an elongated curvilinear object of varying diameter. As seen in perspective, the cutter 10 comprises a handle 12, and a cap 14. The handle 12 has a bulbous base 16, and a thinner neck 18.

The handle 12 is tubular, and is open at the top 20 of the neck 18.

The cap 14 is also bulbous in shape, and tubular. It is open at the lower end 22 thereof.

The external diameters of the lower end 22 of the cap 14, and the diameter of the top 20 of the neck 18 are the same. Thus, as seen in FIG. 1, when the cap 14 is in place over the projecting blade and blade support structure (not shown), the appearance of the precision cutter 10 is one of a unitary object.

Figure 6:
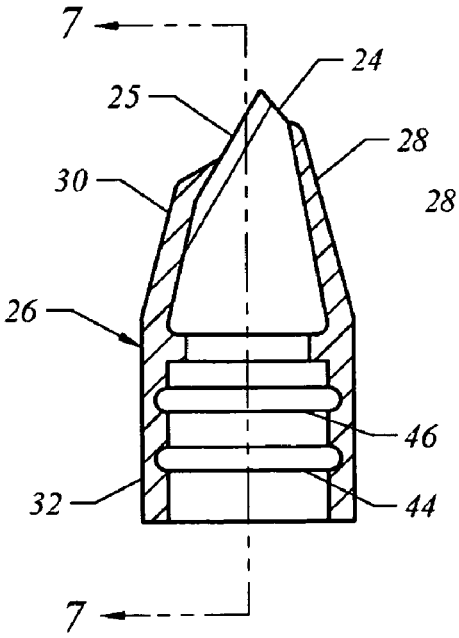
FIG. 6 is a cross-sectional view of one part of the blade support structure, forming a part of the cutter of the invention, showing the position of the blade within the support structure.
Figure 7:
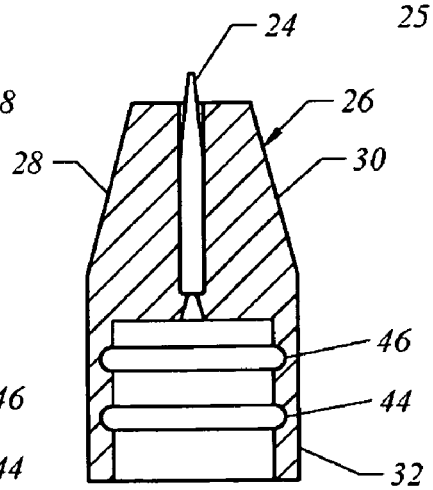
FIG. 7 is a view along line 7-7 of FIG. 6, showing the position of the blade in the blade support structure, looking down from the top.
Figure 8:
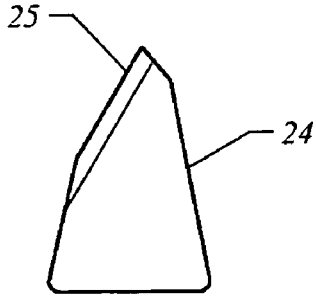
FIG. 8 is a side view of the blade used in the precision cutter of the invention.

A blade 24 having a sharp cutting edge 25 for the cutter is shown in FIGS. 6, 7 and 8, in particular. The blade 24 can be made of any material that is capable of maintaining a sharp cutting edge, but preferably it is made of steel or a ceramic material.

The blade 24 is imbedded in a blade support structure 26 comprising two individual components.

A first component 28 is molded around the blade 24 at its upper end 30, and has a tubular configuration at its lower end 32. The blade 24 is mounted in the blade support structure 26 in a manner such that its cutting edge 25 is parallel to horizontal surfaces, when the cutter 10 is held at an approximate angle of about 45 degrees relative to horizontal. See FIG. 8, showing the angle of the cutting edge 25 of the blade 24.

Figure 2:
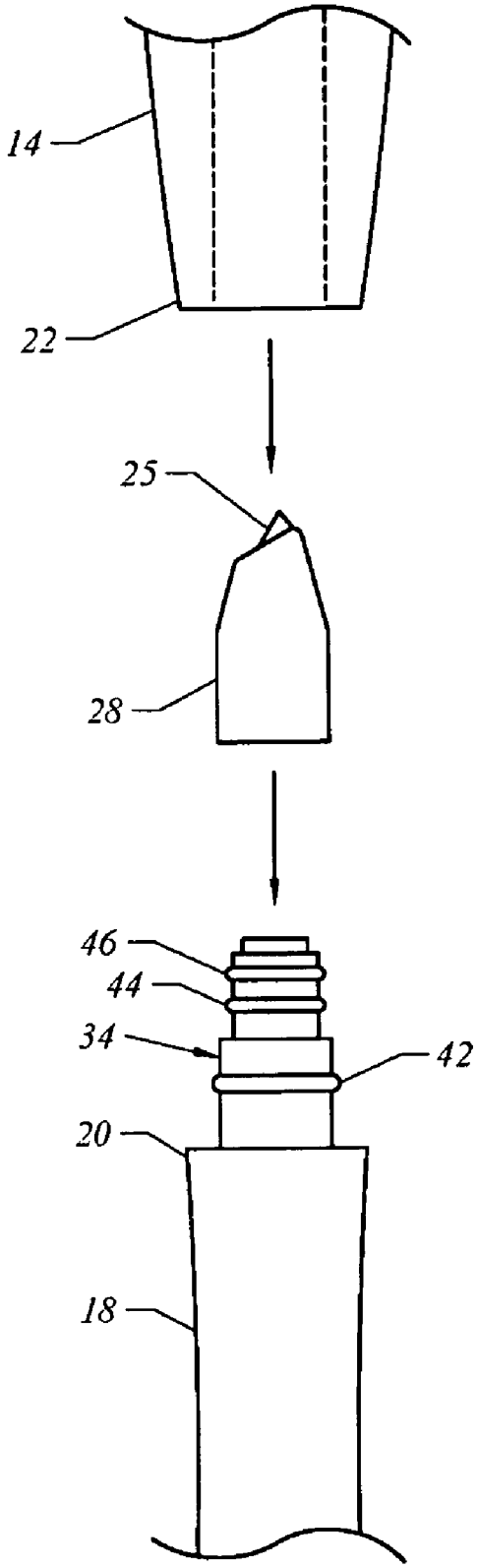
FIG. 2 is a view of the cutter of the invention, with parts broken away, showing the relationship of the blade and blade support structure, with the handle and the cap.
Figure 3:
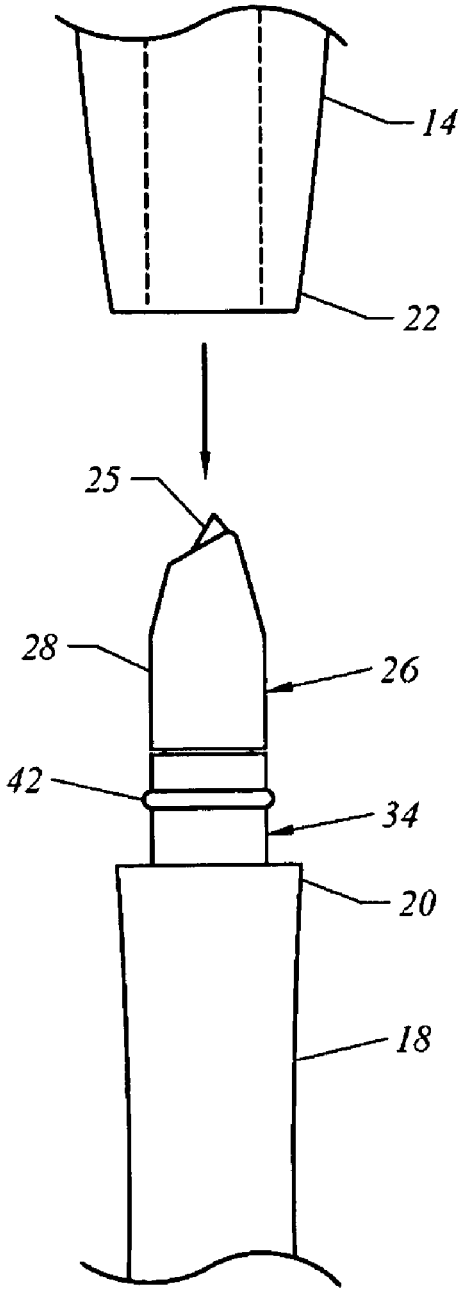
FIG. 3 is another view of the cutter of the invention, with parts broken away, showing another aspect of the relationship of the blade, the blade support structure, with the handle, and the cap.
Figure 4:
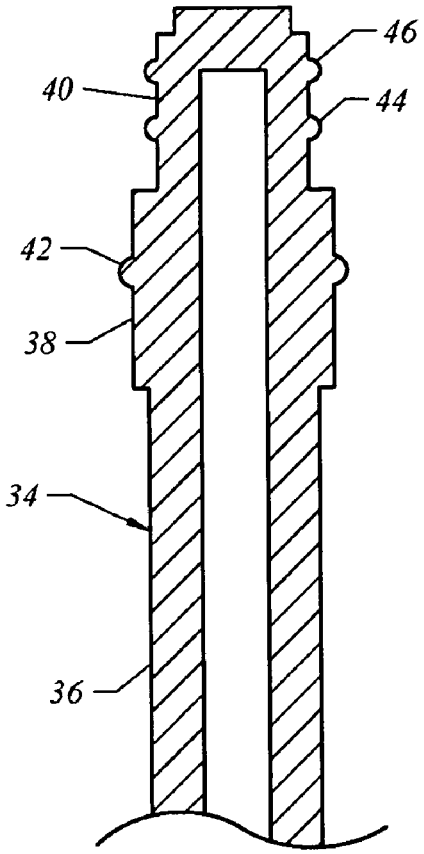
FIG. 4 is a cross-sectional view of one part of the blade support structure of the cutter of the invention.
Figure 5:
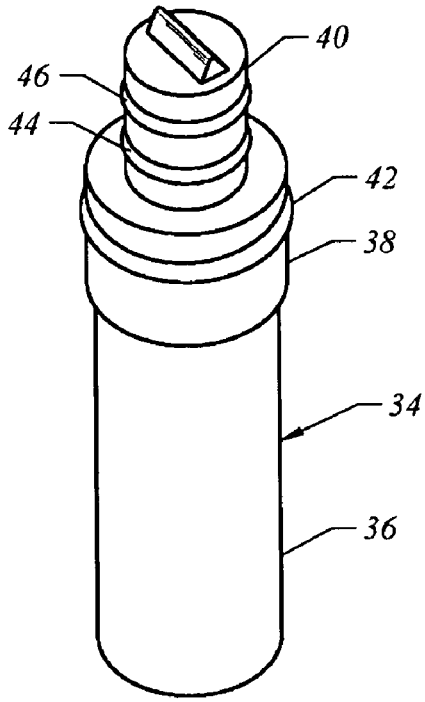
FIG. 5 is a perspective view of one part of the blade support structure, forming a part of the cutter of the invention.
Figure 9:
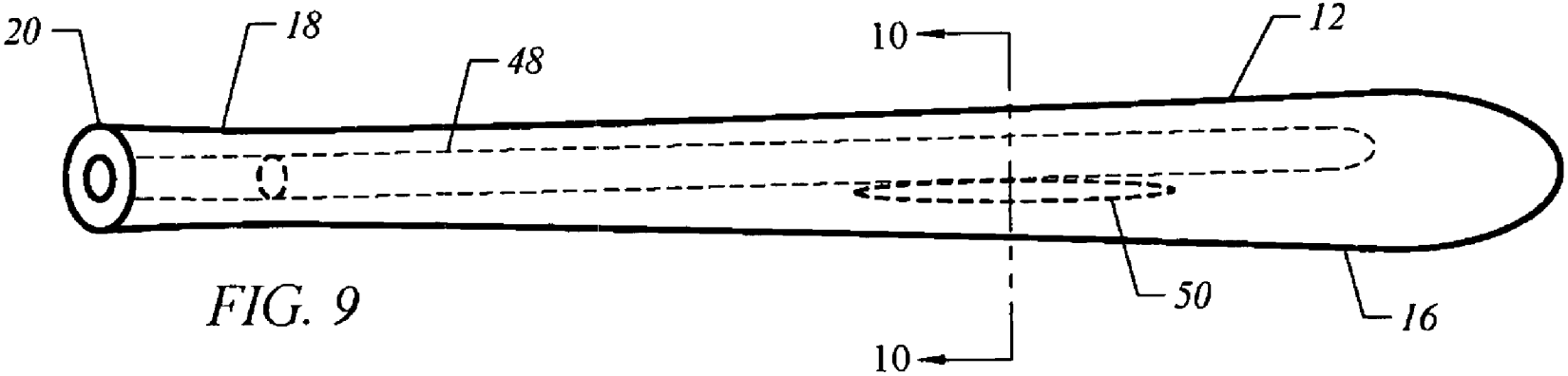
FIG. 9 is a side view of the handle of the precision cutter of the invention, with parts shown in phantom, showing a weight positioned inside the handle.
Figure 10:
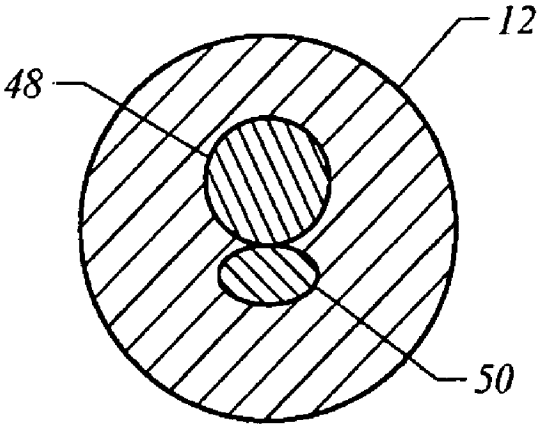
FIG. 10 is a cross-sectional view through the line 10-10 of FIG. 9.

The second component 34 of the blade support structure 26 is cylindrical in shape, and hollow at its center. As seen in FIGS. 4 and 5 the second component 34 has a lower section 36 of reduced diameter, a middle section 38 of slightly enlarged diameter, and a top section 40 of reduced diameter. The external diameter of the lower section 36 is slightly less than the internal diameter of the opening at the top 20 of neck 18 of the handle 12, so that the lower section 36 of the second component 34 of the blade support structure 26 can be inserted into the tubular opening in the top 20 of the handle 18, as seen in FIGS. 2, 3, and 9.

The lower edge of the middle section 38 then abuts the edge at the top 20 of the neck 18 of the handle 12, preventing further penetration of the second component 34 into the opening in the handle 12.

A circular ring 42 is molded around the middle section 38, projecting outward from the surface thereof, for reasons explained below.

The reduced diameter top section 40 also has two circular rings, 44 and 46, molded around it, projecting outward therefrom.

As seen in FIG. 9, the handle 12 is hollow in its center. A weight 48 is positioned in the hollow center of the handle 12. The weight 48 is cylindrical and can be made of iron, steel, or other heavy metal or material. It is desirable that the weight 48 be off center of the central axis of the handle 12, thus the weight is supported by a support cushion 50 at a point near the base 16 of the handle 12. The cushion 50 pushes the weight off the central axis. The cushion can be plastic, fabric, or other substance. The purpose of the off center weight 48 this is so that when the cutter 10 is rolled on a flat surface, the cutter 10 will come to a stop at the same position each time. This insures that any identifying indicia on the outer surface of the cutter 10 is always correctly placed. Thus, any advertising that may be imprinted on the outer surface can be placed thereon, with the certain knowledge that it will always is visible to the user of the cutter, or anyone else visualizing it when the cutter is laying on a flat surface.

In the manufacture of the cutter 10 of this invention, the first component 28 containing the blade 24, is slipped over the second component 34, and held in place by the pressure of the internal surface of the component 28 against the rings 44, and 46. Thereafter, the second component 34 is inserted into the open end of the handle 12 as far as possible. This is illustrated in FIGS. 2 and 3. Once the blade 24, and blade support structure 26 are in position and secured to the handle 12, the cap 14 is then slipped over the blade 24, and blade support structure 26, and secured in place by friction fit of the internal surface of the cap 14 against the ring 42.

The handle 12 and cap 14 are preferable made of plastic, but could also me made of a metal such as aluminum, if desired.

As will be recognized by those of ordinary skill in the pertinent art, numerous modifications and substitutions may be made to the above described embodiment of the present invention without departing from the scope of the invention. Accordingly, the preceding portion of this specification is to be taken as illustrative, as opposed to a limiting sense.

What is claimed is:

1. A precision cutter comprising:

an elongated hollow handle having a central axis, a curvilinear surface, a bulbous end section, a thin neck section and one open end at the top of said thin neck section;

a first blade support component having an upper end and a hollow tubular lower end, a second blade support component, having a cylindrical shape, hollow center, a reduced diameter lower section, a slightly enlarged diameter middle section and a reduced diameter top section, wherein said reduced diameter lower section is received in the open end of said thin neck section, wherein said slightly enlarged diameter middle section abuts a top edge of said open end of said thin neck section, wherein said slightly enlarged diameter middle section has a circular ring molded around a circumference of said slightly enlarged diameter middle section, wherein said reduced diameter top section has two circular rings molded around said circumference;

wherein said first blade support component is attached to said second blade support component by internal pressure created between said hollow tubular lower end of said first blade support component and said two circular rings of said second blade support component;

a blade imbedded in said upper end of said first blade support structure component and projecting forward along said central axis;

a hollow cap having a curvilinear surface, a bulbous configuration at one end and one open end adapted to fit over said blade and blade support structure, said cap when in place being complementary to and abutting said handle section, the external surface thereof being contiguous with the external surface of said handle section at the point where they meet; and a cylindrical weight imbedded in the hollow of said handle eccentric to the central axis thereof, and which causes said handle to consistently return to a given position when allowed to roll freely on a surface.

2. The cutter of claim 1 wherein the external diameter at the top of said thin neck section, and the external diameter at the open end of said cap are identical to each other.

3. The cutter of claim 1 wherein the cutting edge of said blade is positioned at an angle of about 45 degrees relative to the central axis of said cutter, such that when said cutting edge of said blade is positioned parallel to a horizontal surface, the angle of inclination of said cutter relative to said horizontal surface is about 45 degrees.

4. The cutter of claim 1 wherein said cylindrical weight is supported within said hollow handle by a cushion material, such that said weight is maintained on an eccentric axis relative to said handle.

5. The cutter of claim 4 wherein said weight is made of iron or other heavy metal.

6. The cutter of claim 1 wherein said blade support structure comprises a first component and a second component, connectable to each other, and wherein said blade is embedded in one of said components.

7. The cutter of claim 1 wherein the angle of the cutting edge of said blade, relative to horizontal, is 45 degrees.

8. The cutter of claim 1 wherein said blade is a ceramic blade.

9. The cutter of claim 1 wherein said handle and said cap are made of plastic.

* * * * *